US009622585B1

(12) United States Patent
Hsieh

(10) Patent No.: US 9,622,585 B1
(45) Date of Patent: Apr. 18, 2017

(54) SEAT CUSHION STRUCTURE OF CHAIR

(71) Applicant: Kun-Yu Hsieh, Tainan (TW)

(72) Inventor: Kun-Yu Hsieh, Tainan (TW)

( * ) Notice: Subject to any disclaimer, the term of this patent is extended or adjusted under 35 U.S.C. 154(b) by 83 days.

(21) Appl. No.: 14/863,498

(22) Filed: Sep. 24, 2015

(51) Int. Cl.

| | |
|---|---|
| ***A47C 7/30*** | (2006.01) |
| ***A47C 23/00*** | (2006.01) |
| ***A47C 7/26*** | (2006.01) |
| ***A47C 7/28*** | (2006.01) |
| *A47C 23/16* | (2006.01) |
| *A47C 23/26* | (2006.01) |

(52) U.S. Cl.
CPC ..... *A47C 7/26* (2013.01); *A47C 7/285* (2013.01); *A47C 23/16* (2013.01); *A47C 23/26* (2013.01)

(58) Field of Classification Search
CPC .. A47C 7/30; A47C 7/347; A47C 7/28; A47C 7/021; A47C 7/025; A47C 7/027; A47C 23/26; A47C 23/16; A47C 23/02; A47C 23/00; A47C 3/00; A47C 7/54
USPC ..... 297/452.52, 218.1, 218.3, 218.5, 440.22
See application file for complete search history.

(56) References Cited

U.S. PATENT DOCUMENTS 2,146,136 A * 2/1939 Foote ..... A47C 7/30 267/87
2,669,291 A * 2/1954 Hoven ..... A47C 7/30 267/102
3,146,028 A * 8/1964 Grosfillex ..... A47C 3/12 297/440.22
3,556,594 A * 1/1971 Anderson ..... A47C 4/02 297/440.22
3,702,204 A * 11/1972 Tipton ..... A47C 1/12 297/248
4,065,181 A * 12/1977 Gunlock ..... B60N 2/7023 297/440.22
6,942,300 B2 * 9/2005 Numa ..... A47C 7/282 297/218.3
2004/0004386 A1 * 1/2004 Guillot ..... A47C 7/30 297/452.52
2006/0071522 A1 * 4/2006 Bedford ..... A47C 1/023 297/300.2
2008/0106136 A1 * 5/2008 Heidmann ..... A47C 7/28 297/452.56
2016/0316925 A1 * 11/2016 Qi ..... A47C 7/28

FOREIGN PATENT DOCUMENTS

TW M482324 U 7/2014

* cited by examiner

*Primary Examiner* — Phi A
(74) *Attorney, Agent, or Firm* — Rosenberg, Klein & Lee

(57) ABSTRACT

A seat cushion structure of chair is provided, in which a seat cushion body has a chamber provided on its upper end surface. The chamber has holders provided on its two opposite walls, and a plurality of spring steel wires have their two ends fixed on the holders provided on the opposite walls of the chamber so as to span across the chamber. An elastic pad covers correspondingly the upper end surface of the seat cushion body in such a manner that user, when sits on the elastic pad, enjoys comfortable and elastic feeling by the support of the elastic pad and the spring steel wires provided under the elastic pad. Furthermore, user's body heat can be dissipated through perforations provided on the elastic pad to the chamber of the seat cushion and thus to the outside, so as to enhance user's comfort.

6 Claims, 4 Drawing Sheets

SEAT CUSHION STRUCTURE OF CHAIR

BACKGROUND OF INVENTION

Field of the Invention

The present invention relates to a seat cushion structure of chair, more particularly to a seat cushion structure of chair which provides comfortable elastic feeling and effective dissipation of user's body heat.

Brief Description of Prior Art

Current seat cushion of chair is mainly formed by applying adhesive on a base plate made of wood or plastic plate, next adhering resin foam on the base plate, further applying adhesive on the resin foam, then pasting a top cloth on the resin foam, and finally conducting peripheral treatment. So, the production process of conventional seat cushion of chair is not only cumbersome, time-consuming and labor intensive, but also toxic gas will be volatilized in the applying process of the adhesive such as might bond. Moreover, it tends to have uneven application and weak bonding defects in adhesive applying process. Furthermore, when conventional seat cushion bears against user's whole weight, it will be pressed to become compact shape, causing user's body heat difficult to dissipate through the resin foam. In addition, the solid base plate under the resin foam further makes the heat dissipation becoming more difficult, and this may cause discomfort of user sitting thereon. Furthermore, the resin foam will become aging to lose elasticity gradually after a period time of use, and this may cause more and more serious discomfort of user sitting thereon.

Therefore, the inventor of present invention has developed an invention entitled "Seat Cushion of Chair" disclosed in Taiwanese Patent Gazette No. M382324 U, in which a seat cushion body has an elastic permeable base, the frame hollow portion of which has a plurality of spring steel wires spanning laterally inside. A soft pad is placed on the elastic permeable base in such a manner that user, when sits on the soft pad, enjoys comfortable and elastic feeling by the support of the soft pad and the elastic permeable base. Moreover, user's body heat can be dissipated through the soft pad and the elastic permeable base. However, the "Seat Cushion of Chair" of Taiwanese Patent Gazette No. M382324 U has high manufacturing cost problem due to frame design of the elastic permeable base. Furthermore, the resin foam placed on the elastic permeable base will become aging to lose elasticity gradually after a period time of use, and this may cause a feeling of thorn pricking coming from the spring steel wires below the soft pad. The sales of chair depends not only on sitting comfort but also on its external design. The seat cushion body of the "Seat Cushion of Chair" of Taiwanese Patent Gazette No. M382324 U is limited by the bending degree of its frame, so that a lacking of its styling change leads its sales to stagnation state.

In view of the defects happened in the "Seat Cushion of Chair" of Taiwanese Patent Gazette No. M382324 U, the inventor of the present invention hereby proposes the present invention according to his abundant experience of product development and manufacturing in relevant field and based on his creativity in many respect.

SUMMARY OF THE INVENTION

The present invention relates to a seat cushion structure of chair, the object of which is to provide a seat cushion structure of chair enabling to provide comfortable elastic feeling and effective dissipation of user's body heat.

In order to achieve above object, the seat cushion structure of chair of the present invention mainly comprises:

a seat cushion body having a chamber provided on its upper end surface, a plurality of holders being provided on two opposite walls of the chamber, each holder being provided in such a manner that it corresponds to the holder on the opposite wall;

a plurality of spring steel wires having their two ends fixed on the holders provided on the opposite walls of the chamber so as to span across the chamber;

an elastic pad having its shape formed correspondingly to the upper end surface of the seat cushion body so as to cover the upper end surface of the seat cushion body.

According to abovementioned seat cushion structure of chair, a retaining hole is formed on each of the holders of the seat cushion body, and retaining portions are respectively formed on two ends of each spring steel wire in such a manner that each retaining portion of each spring steel wire is engaged with the corresponding retaining hole.

According to abovementioned seat cushion structure of chair, the upper end surface of the seat cushion body further has a groove formed along the periphery of the seat cushion body, while the bottom side of the elastic pad is correspondingly formed with a flange along the periphery of the elastic pad in such a manner that the flange of the elastic pad can be inserted into the groove of the seat cushion body.

According to abovementioned seat cushion structure of chair, a plurality of tapped holes are provided on the bottom wall of the groove of the seat cushion body, and a plurality of tapped holes are also correspondingly provided on the end face of the flange of the elastic pad, and a plurality of fastening members are employed to lock into the tapped holes on the groove of the seat cushion body and on the flange of the elastic pad so as to fix the seat cushion body and the elastic pad together.

According to abovementioned seat cushion structure of chair, a plurality of holders are parallelly arranged on opposite walls of the chamber formed in the seat cushion body, and the plurality of spring steel wires fixed on the holders are arranged to be parallel to each other, and gaps are respectively provided between two adjacent spring steel wires.

According to abovementioned seat cushion structure of chair, the elastic pad further has a plurality of perforations provided thereon to communicate with the chamber of the seat cushion body.

According to abovementioned seat cushion structure of chair, the spring steel wires are formed in wave shape.

In this manner, when user sits on the elastic pad, user can enjoys the comfort and elastic feeling by the support of the elastic pad and the spring steel wires below the elastic pad, and user's body heat can be dissipated to the outside through the perforations provided on the elastic pad and through the chamber so as to enhance sitting comfort.

DETAILED DESCRIPTION OF PREFERRED EMBODIMENTS

The technical contents, objects and effect of the present invention will become more apparent by the detailed description in conjunction with the accompanying drawings.

Figure 1:
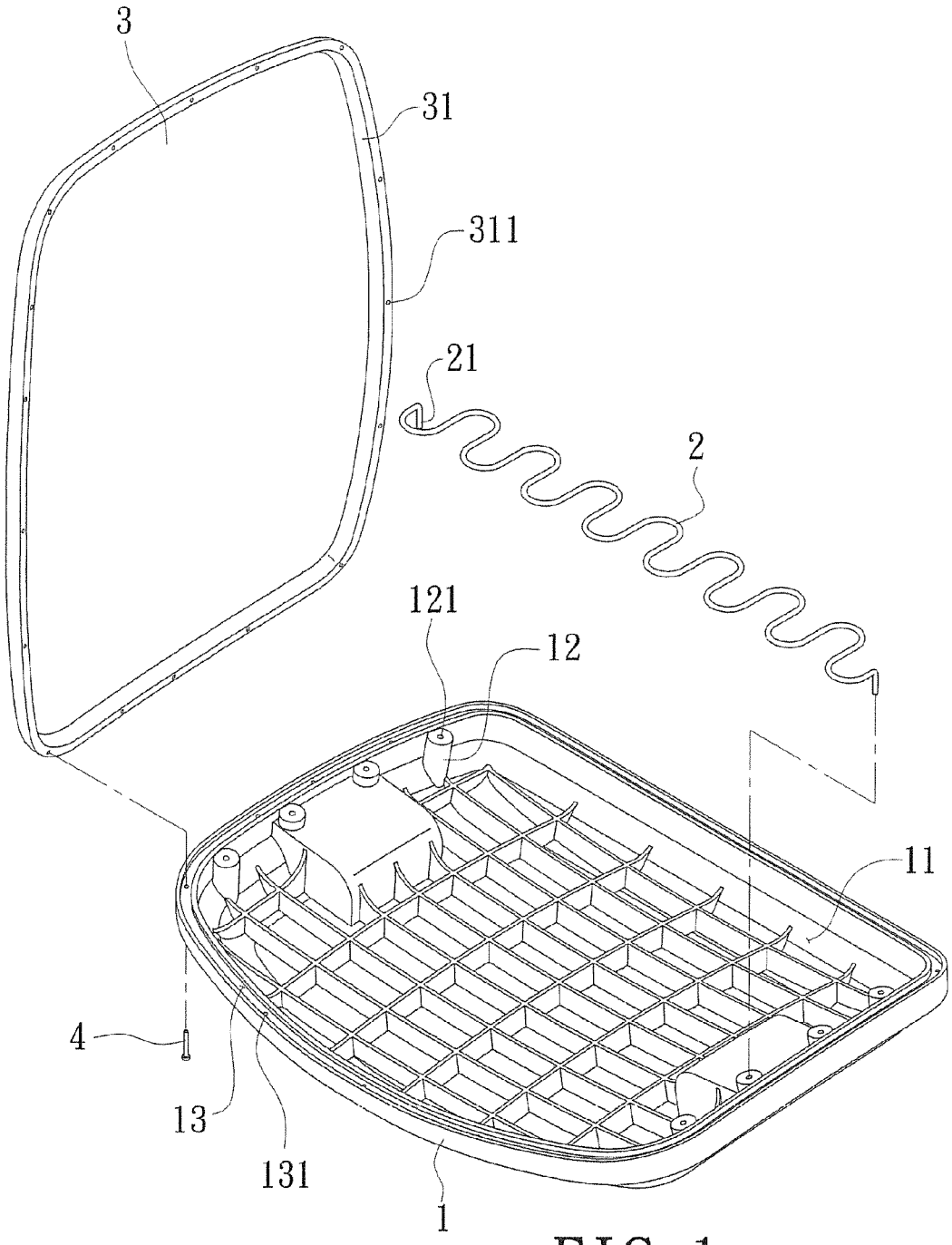
FIG. 1 is a perspective exploded view of the present invention.

Firstly, as shown in FIG. 1, the seat cushion structure of chair of the present invention mainly comprises:

a seat cushion body (1) having a chamber (11) provided on its upper end surface, a plurality of holders (12) being parallelly arranged on two opposite walls of the chamber (11), each holder (12) being provided in such a manner that it corresponds to the holder (12) on the opposite wall; a retaining hole (121) being formed on each holder (12); the upper end surface of the seat cushion body (1) further having a groove (13) formed along the periphery of the seat cushion body (1), and a plurality of tapped holes (131) being provided on the bottom wall of the groove (13) of the seat cushion body (1);

a plurality of spring steel wires (2) spanning across the chamber (11), each spring steel wire (2) having its two ends bent to form retaining portions (21) which are engaged with the retaining holes (121) of the holders (12) provided on the opposite walls of the chamber (11), so that the plurality of spring steel wires (2) can span across the chamber (11) and are parallel to each other, and gaps being respectively provided between two adjacent spring steel wires (2); and the spring steel wires (2) being formed in wave shape;

an elastic pad (3) formed by elastic plastic material having its shape formed correspondingly to the upper end surface of the seat cushion body (1) so as to cover the upper end surface of the seat cushion body (1); the bottom side of the elastic pad (3) being correspondingly formed with a flange (31) formed along the periphery of the elastic pad (3) in such a manner that the flange (31) of the elastic pad (3) is inserted into the groove (13) of the seat cushion body (1); a plurality of tapped holes (311) being provided on the end face of the flange (31) of the elastic pad (3) in such a manner to correspond to the plurality of tapped holes (131) provided on the groove (13) of the seat cushion body (1); and a plurality of fastening members (4) employed to lock into the tapped holes (131) provided on the groove (13) of the seat cushion body (1) and the tapped holes (311) provided on the flange (31) of the elastic pad (3), so as to lock the seat cushion body (1) and the elastic pad (3) firmly together.

Figure 2:
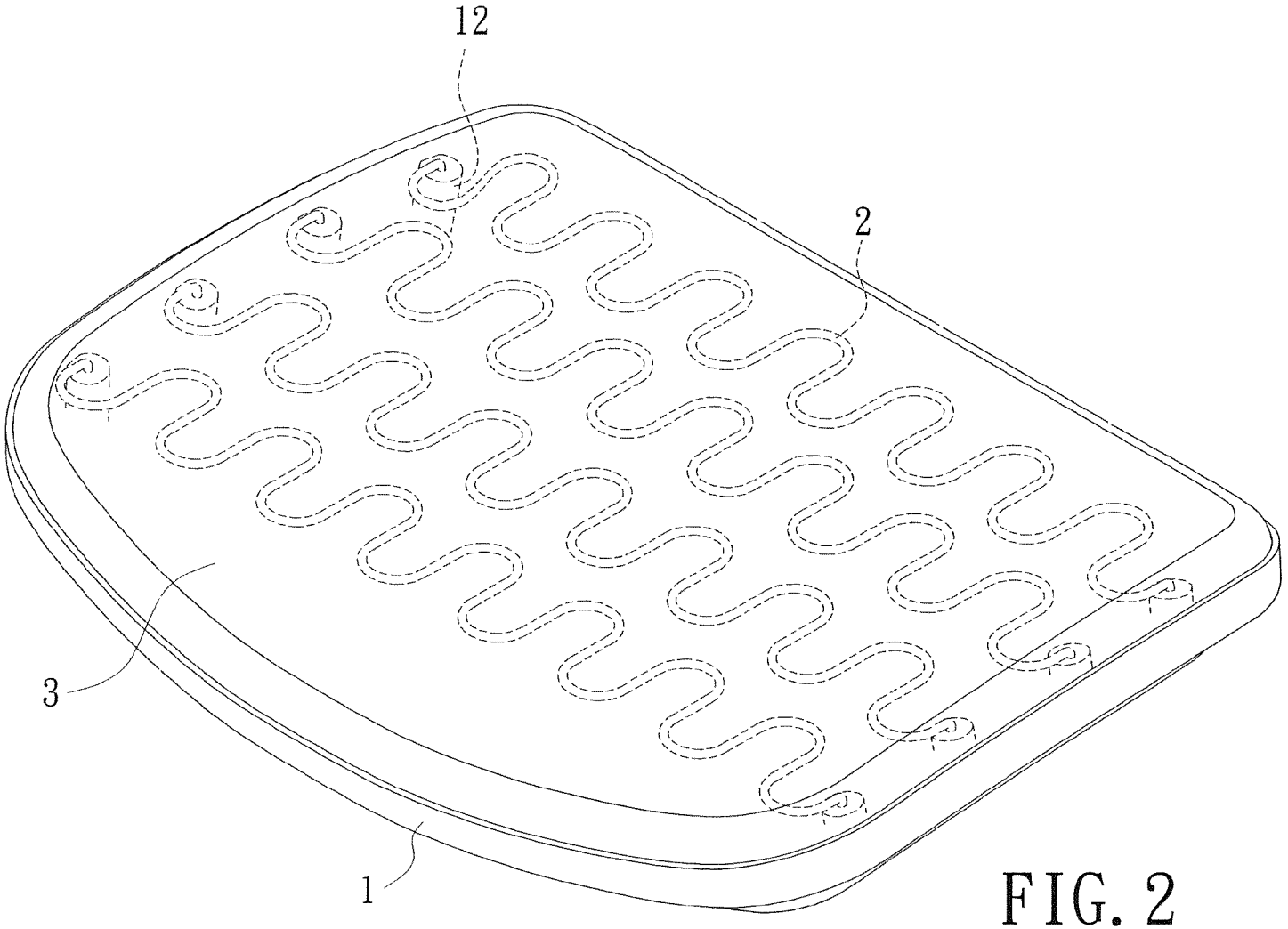
FIG. 2 is a perspective assembly view of the present invention.
Figure 3:
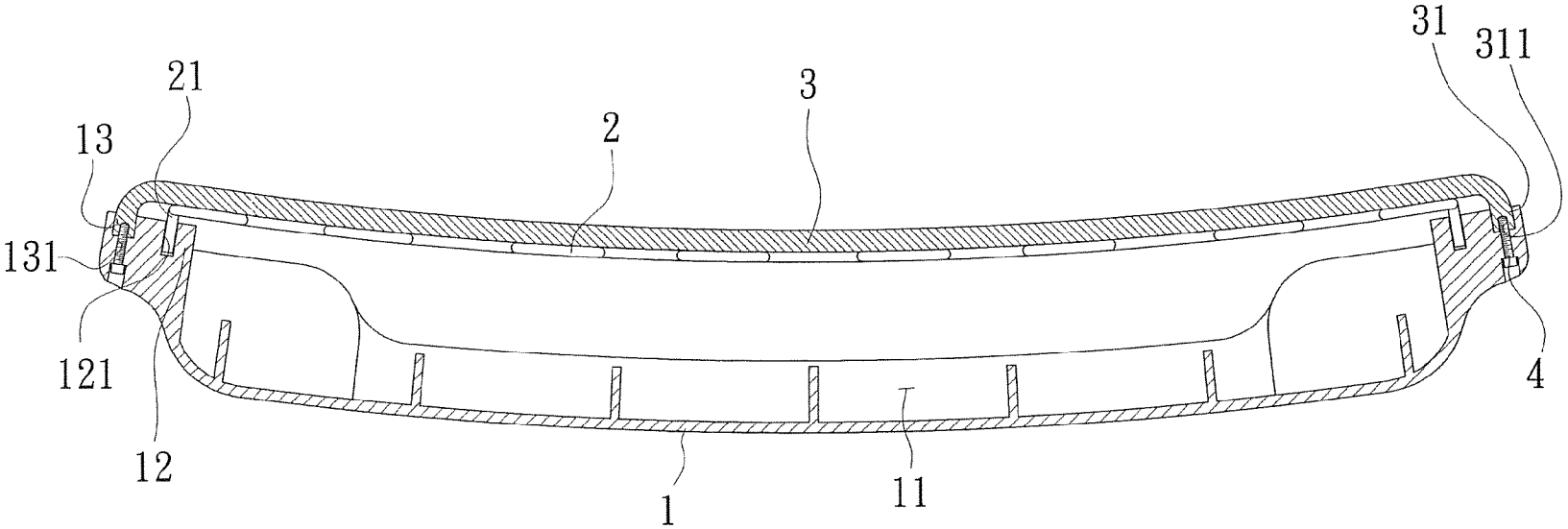
FIG. 3 is an assembly sectional view of the present invention.

Referring to FIGS. 2 and 3, the assembly process will be described as below. Firstly, the retaining portion (21) formed by bending one end of one spring steel wire (2) is engaged with the retaining hole (121) of the holder (12) on one wall of the chamber (11) of the seat cushion body (1), and then the retaining portion (21) on the other end of the one spring steel wire (2) is engaged with the retaining hole (121) of the corresponding holder (12) on the opposite wall of the chamber (11) of the seat cushion body (1). In the same way, the other spring steel wires (2) are assembled in the seat cushion body (1). Next, the elastic pad (3) is placed to cover on the upper end face of the seat cushion body (1), and the flange (31) provided on the periphery of the elastic pad (3) is inserted into the corresponding groove (13) provided on the periphery of the upper end face of the seat cushion body (1), and then the plurality of fasteners (4) are threaded into the tapped holes (131) on the groove (13) of the seat cushion body (1) and then into the tapped holes (311) on the flange (31) of the elastic pad (3), so as to lock them together. In this manner, the assembly of the seat cushion of the present invention is finished. As the spring steel wires of the present invention are assembled directly on the seat cushion body (1) and the elastic pad (3) is formed to corresponding to the shape of the seat cushion body (1), the seat cushion structure of chair of the present invention can be easily manufactured into various design styling in response to market and design demand so as to obtain the favor from the consumer group taking innovative or dazzling things as their favorite.

Figure 4:
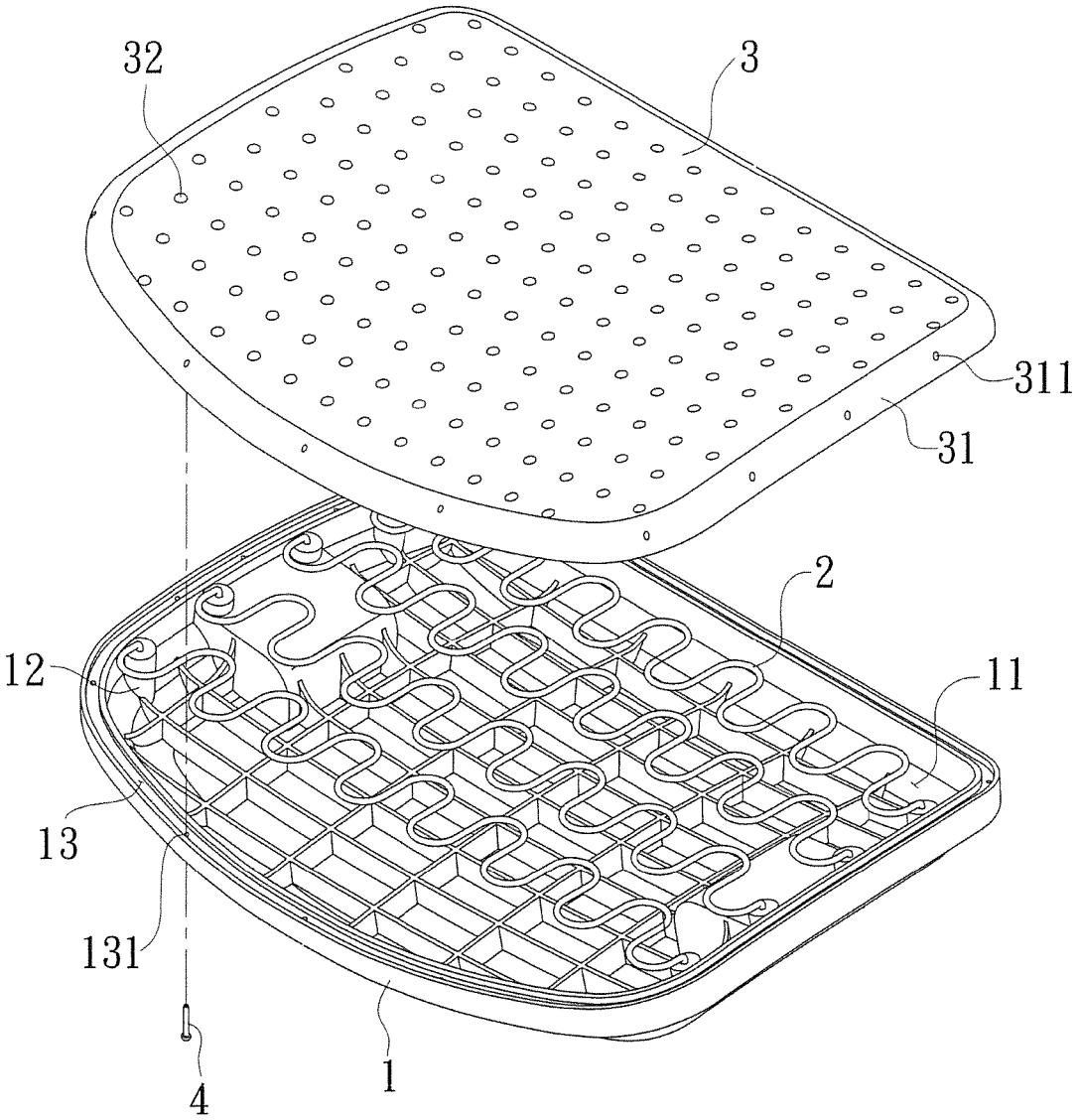
FIG. 4 is a perspective exploded view of another embodiment of the present invention.

Furthermore, user can have his weight stably supported by the elastic pad (3) and the plurality of spring steel wires (2) below the elastic pad (3) to obtain comfortable and elastic feeling when sitting on the elastic pad (3) of the seat cushion of the present invention, so as to avoid hip pain, fatigue after sitting on chair for a long time. Moreover, as the spring steel wires (2) are formed into wave shape, the weight bearing capacity of the spring steel wires (2) can be increased so as to avoid deformation or fracture of the spring steel wires (2) after being sat for a long time. In addition, as the elastic pad (3) of the present invention is made of elastic plastic material so as to have appropriate hardness and elasticity as well, user will not have the feeling of thorn pricking coming from the spring steel wires (2) under the elastic pad (3), when sitting on the elastic pad (3) of the present invention Referring to FIG. 4, still another embodiment of the seat cushion structure of chair of the present invention is shown. A plurality of perforations (32) is provided on the elastic pad (3) of the present invention to communicate with the chamber (11) of the seat cushion body (1). When user sits on the elastic pad (3) for a period of time, the heat emitted from user's hip can dissipate through the plurality of perforations (32) to the chamber (11) of the seat cushion body (1). As there are gaps formed between the adjacent spring steel wires (2), heat dissipation from user's body will not be hindered so as to prevent user's body heat from accumulating in the elastic pad (3) to cause hip hot and humid discomfort.

Based on foregoing, it is apparent that the present invention has the following advantages.

1. The seat cushion structure of chair of the present invention can provide user with feeling of good elasticity by the elastic pad cooperating with the spring steel wires provided underneath when user sits on the elastic pad, so as to avoid hip pain, fatigue of user after sitting for a long time.

2. According to the seat cushion structure of chair of the present invention, the elastic pad is made of elastic plastic material so as to have appropriate hardness and elasticity as well, user will not have the feeling of thorn pricking coming from the spring steel wires under the elastic pad when sitting on the elastic pad. Therefore, sitting comfort can be further enhanced.

3. According to the seat cushion structure of chair of the present invention, as the spring steel wires are formed into wave shape, the weight bearing capacity of the spring steel wires can be increased so as to avoid deformation or fracture of the spring steel wires after being sat for a long time.

4. According to the seat cushion structure of chair of the present invention, a plurality of perforations are provided on the elastic pad so that user's body heat can dissipate through the gaps between the spring steel wires to the chamber of the seat cushion body and to the outside, so as to prevent user's body heat from accumulating in the elastic pad to cause hip hot and humid discomfort.

5. According to the seat cushion structure of chair of the present invention, the spring steel wires are assembled directly in the seat cushion body and the elastic pad is formed to corresponding to the shape of the seat cushion body, so the seat cushion structure of chair can be easily manufactured into various design styling in response to market and design demand so as to meet the demand of various consumer groups and to increase the market sales volume.

While the present invention has been described by preferred embodiments in conjunction with accompanying drawings, it should be understood that the embodiments and the drawings are merely for descriptive and illustrative purpose, not intended for restriction of the scope of the present invention. Equivalent variations and modifications conducted by person skilled in the art without departing from the spirit and scope of the present invention should be considered to be still within the scope of the present invention.

What is claimed is:

1. A seat cushion structure of chair, comprises:

a seat cushion body having a chamber provided on its upper end surface, a plurality of holders being provided on two opposite walls of the chamber, each holder on one wall of the chamber being provided in such a manner that it corresponds to the holder on the opposite wall;

a plurality of spring steel wires having their two ends fixed on the holders provided on the opposite walls of the chamber of the seat cushion body so as to span across the chamber;

an elastic pad having its shape formed correspondingly to the upper end surface of the seat cushion body so as to cover the upper end surface of the seat cushion body wherein a retaining hole is formed on each of the holders of the seat cushion body, and retaining portions are formed on both ends of each spring steel wire in such a manner that each retaining portion of each spring steel wire is engaged with the corresponding retaining hole;

wherein the upper end surface of the seat cushion body further has a groove formed along the periphery of the seat cushion body, while the bottom side of the elastic pad is correspondingly formed with a flange along the periphery of the elastic pad in such a manner that the flange of the elastic pad is inserted into the groove of the seat cushion body;

wherein a plurality of tapped holes are provided on the bottom wall of the groove of the seat cushion body, and a plurality of tapped holes are correspondingly provided on the end face of the flange of the elastic pad, and a plurality of fastening members are employed to lock into the tapped holes on the groove of the seat cushion body and on the flange of the elastic pad so as to fix the seat cushion body and the elastic pad together.

2. The seat cushion structure of chair as claimed in claim 1, wherein the plurality of holders are parallelly arranged on opposite walls of the chamber formed in the seat cushion body, and the plurality of spring steel wires fixed on the holders are arranged to be parallel to each other, and gaps are respectively provided between the adjacent spring steel wires.

3. The seat cushion structure of chair as claimed in claim 2, wherein the elastic pad further has a plurality of perforations provided thereon to communicate with the chamber of the seat cushion body.

4. The seat cushion structure of chair as claimed in claim 3, wherein the spring steel wires are formed in wave shape.

5. The seat cushion structure of chair as claimed in claim 1, wherein the plurality of holders are parallelly arranged on opposite walls of the chamber formed in the seat cushion body, and the plurality of spring steel wires fixed on the holders are arranged to be parallel to each other, and gaps are respectively provided between the adjacent spring steel wires.

6. The seat cushion structure of chair as claimed in claim 1, wherein the elastic pad further has a plurality of perforations provided thereon to communicate with the chamber of the seat cushion body.

* * * * *